US005194186A

United States Patent [19]

Edlund

[11] Patent Number: 5,194,186

[45] Date of Patent: Mar. 16, 1993

[54] AUTOMATIC CHOKE

[75] Inventor: Dag H. Edlund, Huskvarna, Sweden

[73] Assignee: Aktiebolaget Electrolux, Stockholm, Sweden

[21] Appl. No.: 807,253

[22] Filed: Dec. 13, 1991

[30] Foreign Application Priority Data

Jan. 29, 1991 [SE] Sweden ..... 9100275

[51] Int. Cl.[5] ..... F02M 1/14

[52] U.S. Cl. ..... 261/64.4; 251/305; 137/855

[58] Field of Search ..... 261/64.4, 64.3, 64.6, 261/41.5; 251/305; 137/855

[56] References Cited

U.S. PATENT DOCUMENTS

| | | | |
|---|---|---|---|
| 1,413,371 | 4/1922 | Adler et al. | 261/64.4 |
| 1,968,553 | 7/1934 | Heitger | 261/64.4 |
| 2,140,734 | 12/1938 | Chandler | 261/64.3 |
| 2,372,726 | 4/1945 | Langdon | 137/855 |
| 3,005,523 | 10/1961 | May | 137/855 |
| 3,328,011 | 6/1967 | Winkler et al. | 261/64.6 |
| 4,241,704 | 12/1980 | Ishida | 261/41.5 |
| 4,540,457 | 9/1985 | LaValley | 251/305 |
| 4,786,031 | 11/1988 | Waldrop | 251/305 |

FOREIGN PATENT DOCUMENTS

| | | | |
|---|---|---|---|
| 2841082 | 4/1979 | Fed. Rep. of Germany | 261/65 |
| 433083 | 1/1988 | Fed. Rep. of Germany | 261/65 |
| 687987 | 8/1930 | France | 261/64.4 |
| 0018171 | 1/1988 | Japan | 261/64.4 |

OTHER PUBLICATIONS

The American Heritage Dictionary, Apr. 1982, p. 442.

*Primary Examiner*—Tim Miles

*Attorney, Agent, or Firm*—Pearne, Gordon, McCoy & Granger

[57] ABSTRACT

The starting of an i.c. engine usually takes place by carrying out the necessary number of starting attempts with the carburetor choked in order to obtain an ignition. After that, the choke valve (15,23,24) is opened and the engine can be started by making more starting attempts. Thus, the engine does not continue to run when the choke is on. In order to simplify the starting procedure of e.g. a chain saw, the carburetor can be provided with an elastic choke valve. The elastic valve makes the engine start even though the choke valve is closed as the choke valve will yield to the air stream (FIG. 1) and furnish fuel air mixture to the engine. With the engine running, the choke valve can then be opened.

3 Claims, 1 Drawing Sheet

AUTOMATIC CHOKE

The present invention relates to a choke arrangement for a carburetor of an internal combustion engine, preferably a small engine intended for hand tools, garden and hobby tools.

A common arrangement for enriching the combustion gas when starting an engine is a so-called flooding of the carburetor wherein the float of a float carburetor is pressed down manually by means of a button thereon, so that the fuel flows in and the level in the float chamber exceeds its normal position. With the higher level more fuel is mixed into the gas and the enrichment aimed at is reached. Another arrangement for enrichment is a choke valve in the carburetor passage causing the air stream in the passage to become throttled and accordingly a proportionally larger amount of fuel is mixed into the gas. Small engines, as referred to in this context, have a rope start rotating the engine shaft a number of revolutions when somebody pulls the rope. When the carburetor is choked it occurs that enriched gas is sucked into the engine. After several pulls by the rope, a first ignition takes place which is an indication that there is a sufficient quantity of fuel in the cylinder for starting the engine. In order that not too much fuel be entered, the choke must be opened as the engine cannot operate on such highly enriched fuel.

For many persons handling engines it is difficult to decide when the choke should be opened—if it happens too late, there is a risk that the engine will not start. Therefore, it would be preferable to have an automatic choke that opens the choke valve as soon as the first ignition occurs. The existing problem is thus to utilize a feature of the engine that appears when it is prepared for start, i.e. enters into operation.

According to the invention a solution of the problem has been presented which utilizes the increased suction power effected by the engine when igniting the gas. If the choke valve is made of elastic material, a partial opening occurs that increases as the running speed of the engine increases. The increased air flow provides the leaner mixture required by the engine in order to keep running. An arrangement that results in such an improvement of the engine and that solves the presented problem has the features set forth in more detail in claim 1.

Figure 1:
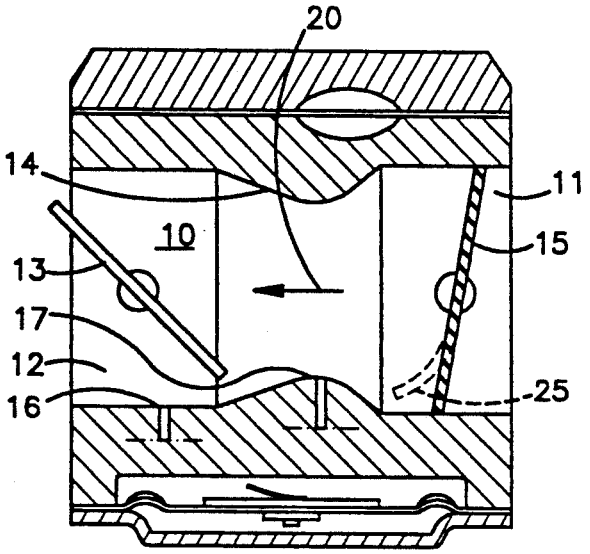
Figure 2:
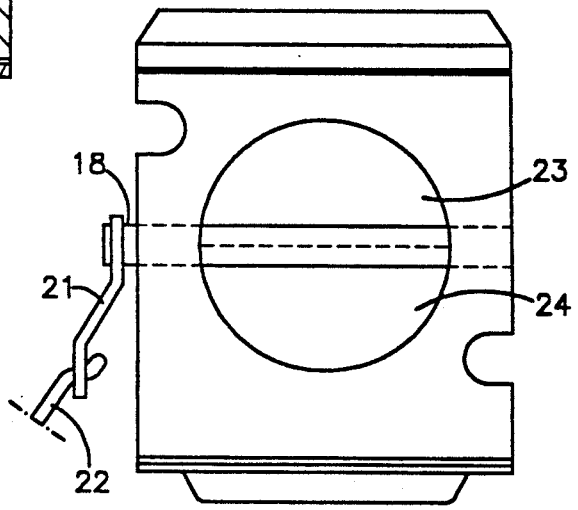
Figure 3:
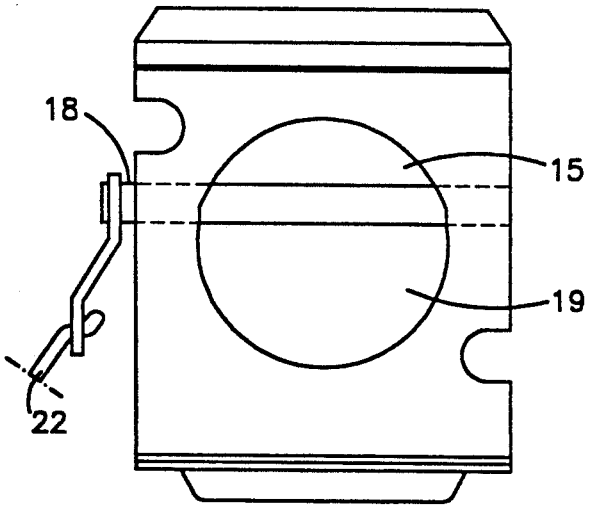
Figure 4:
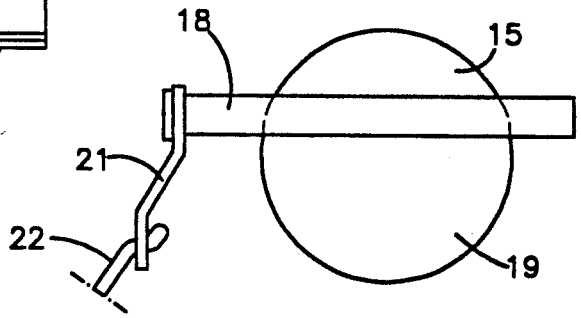

An embodiment of an automatic choke according to the invention is described in the following with reference to the drawing attached in which FIG. 1 is a section of a simplified diaphragm carburetor with a choke according to the invention, FIG. 2 is an end elevation of the carburetor, FIG. 3 is an end elevation of the carburetor with a modification of the choke valve, and FIG. 4 is an elevation of the choke valve.

The carburetor shown in FIG. 1 is a so-called diaphragm carburetor that is commonly used in i.a. chain saws. A through flow passage 10 extending from an inlet end 11 to an outlet end 12 contains a throttle valve 13, a venturi 14, a choke 15 and nozzles 16, 17 in the wall of the passage.

A preferred embodiment of the choke illustrated in FIG. 3 comprises a valve shaft 18 located asymmetrically on the valve disc. As the latter is made of rubber cloth or some other elastomer, the lower part 19 will be bent by an air stream in the direction of the arrow 20 to the shape shown in dashed lines 25 in FIG. 1. The solid line position of the valve disc shows that the passage 10 is in principle closed, i.e. the choke is applied. The choke is controlled in the usual manner by means of a level 21 on the shaft and a tension bar 22 extending the lever to a panel or the like. The operator can thereby adjust the choke to any selected position, but the bending caused by an increased air stream in the passage occurs automatically. As said in the introduction, such bending takes place when the engine begins to ignite and, consequently, the air suction in the passage increases. As soon as the choke adjustment is no longer required, after the engine has started, the operator need only set the choke in the open position.

The described embodiment is only an example of an embodiment of the invention. Among the modifications it can be mentioned that the valve disc is made in two parts, one rigid 23, and one elastic 24, but it is only the elastic part that participates in the bending that provides a partial opening of the choke. Naturally the arrangement can also be applied on a float carburetor whereby any arrangement for flooding of the same can be excluded.

I claim:

1. A carburetor, comprising an induction passage including a choke valve on the air inlet, said choke valve being a one-piece, flexible disc journalled by means of a shaft in the carburetor and adapted to bend partially open when the engine begins to ignite.

2. A carburetor according to claim 1, wherein the disc is flexible by a specified pressure differential on opposing faces of the disc.

3. Choke according to claim 1, wherein the shaft (18) is arranged asymmetrically with regard to the plane of the valve means, thereby dividing the surface thereof into a larger and a smaller part.

* * * * *